US005437549A

United States Patent [19]

Saito

[11] Patent Number: 5,437,549

[45] Date of Patent: Aug. 1, 1995

[54] GAS LIGHTER WITH SAFETY DEVICE

[75] Inventor: Masaki Saito, Shizuoka, Japan

[73] Assignee: Tokai Corporation, Shizuoka, Japan

[21] Appl. No.: 72,775

[22] Filed: Jun. 7, 1993

[30] Foreign Application Priority Data

Jun. 12, 1992 [JP] Japan ..... 4-179067
Dec. 9, 1992 [JP] Japan ..... 4-329471

[51] Int. Cl.[6] ..... F23D 11/36
[52] U.S. Cl. ..... 431/153; 431/277
[58] Field of Search ..... 431/153, 277, 256

[56] References Cited

U.S. PATENT DOCUMENTS 3,898,031 8/1975 Rusakowicz .
4,589,172 5/1986 Hoenigs .
4,784,602 11/1988 Nitta .
4,786,248 11/1988 Nitta .
5,002,482 5/1991 Fairbanks .
5,074,781 12/1991 Fujita ..... 431/153
5,090,893 2/1992 Floriot ..... 431/153
5,165,886 11/1992 Frigiere ..... 431/153 X
5,186,618 2/1993 Shike et al. ..... 431/153
5,205,729 4/1993 Iwahori ..... 431/153
5,213,493 5/1993 Iwahori ..... 431/153
5,224,854 7/1993 Arnsquer ..... 431/153
5,242,297 9/1993 Cirami ..... 431/153

FOREIGN PATENT DOCUMENTS 3-025215 2/1991 Japan .
3-501647 4/1991 Japan .

*Primary Examiner*—Carl D. Price
*Attorney, Agent, or Firm*—Brumbaugh, Graves Donohue & Raymond

[57] ABSTRACT

A gas lighter with a safety device for locking an actuating lever which causes the emission of fuel, wherein the safety device automatically returns to the locking state after the ignition of the lighter, thereby preventing the lighter from being left in the released state, preventing inadvertent ignition of the lighter, and improving the reliability of the safety device. A path is defined on the upper surface of a lighter body, and a locking member slidably engages the path, wherein the locking member is provided with, at one end thereof, an engaging recess and, at the other end thereof, a blocking end. An actuating lever is provided with a skirt, a recess, and a leg. A holding member including a cantilever arm is integrally formed on the wall surface which faces the path, wherein an angled engaging part and a protuberance are formed on the end of the cantilever. When the locking member is slidably moved along the path, so that the angled engaging part engages the engaging recess, the blocking end part abutting against the skirt enters the recess, and the leg forces down the protuberance, thereby releasing the lock mechanism.

2 Claims, 14 Drawing Sheets

GAS LIGHTER WITH SAFETY DEVICE

BACKGROUND OF THE INVENTION

1. Field of the Invention

This invention relates to a gas lighter with a safety device and, more particularly, to a gas lighter with a so-called child resistant type safety device which is intended to prevent the inadvertent ignition of the lighter by deterring the depression of an actuating lever thereof while it is not in use.

2. Description of the Prior Art

Though a gas lighter is a convenient tool which can easily be ignited by the depression of the actuating lever, it can be a safety hazard for those who, like children, do not know the proper use of the lighter.

To prevent such a hazard, various types of child resistant gas lighters have been proposed. Most of the safety devices built into these child resistant gas lighters have a lock mechanism which prevents the depression of the actuating lever and which must be released to allow the actuating lever to be depressed. However, any of the conventional-type child resistant gas lighters have drawbacks in their usage and thus it is desirable that the gas lighters be improved for practical use.

For example, as disclosed in U.S. Pat. Nos. 4,589,172, 4,786,248 and 4,784,602, any one of the disclosed safety devices is provided with a locking member for deterring the depression of the actuating lever. Since the locking member has to be manually moved between the locking position and the release position, the locking member tends to stay in the release position if it is not manually moved from the release position to the initial position after the lighter is used, so that the safety device remains unlocked. Leaving the locking member in the release position permits the actuating lever to be depressed, rendering the safety device inoperable. Specifically then, to ensure safety, the existing safety devices always have to be manually relocked after the lighter is used with the lock mechanism unlocked, and further safety improvements in the lock mechanism has been anticipated.

To solve the drawbacks set forth above, as a safety device having a locking member to impede the depression of the actuating lever, safety devices with what is called an autoreturn function have been proposed wherein the locking member automatically returns to the locking position in response to the igniting operation after the locking member has been manually moved to the release position. Examples of such safety devices include those shown in U.S. Pat. No. 5,002,482, Japanese Unexamined Patent Publication No. 3(1991)-25215 and U.S. Pat. No. 3,898,031 which have the auto-return function to allow the automatic returning of the locking member to the locking position in response to the ignition operation. With these safety devices, however, releasing the lock mechanism is only achieved by the motion of a finger along an L-shaped path, thereby resulting in the lock mechanism being inferior, in terms of operability, in the ease of releasing the locking member such that a lighter of this type generally requires operation with a single finger, such as a thumb, thus leading to different results depending on the users. Therefore, safety devices of this type can be said to be disadvantageous in practical use. Further, the locking member itself is made of a resilient material, and hence it is possible that the locking member will return to the locking position under its own resilience after having been moved to the release position, thereby resulting in the unreliable operation of the safety device.

Furthermore, there have been proposed safety devices wherein the locking member is released by the motion of a finger along a simple linear path instead of the L-shaped path, but any of those also have drawbacks in practical use. A safety device, for instance, known from Japanese Patent Publication of Translated Version (PCT) No. 3(1991)-501647 is provided with an automatic return function wherein part of a locking member being composed of a spring is moved along an actuating path to the release position and held there, then it automatically returns to the locking position in response to the ignition operation. In this type of safety device, the arrangement for regulating the release of the spring-like locking member is not satisfactory, and accordingly the locking member cannot be steadily released. This adversely affects the ease of releasing the lock mechanism in the gas lighter, which is generally operated with a single finger, and, as with the preceding example, the resulting operations will be different depending on the users.

As has been described above, any one of the existing child-resistant type safety devices has drawbacks in practical use, and hence there are growing demands for a safety device improved in both safety, more than ever, and operability.

SUMMARY OF THE INVENTION

Therefore, a primary object of this invention is to provide a gas lighter with a safety device which is capable of effecting the automatic operation of a lock mechanism without a manual relocking operation after actuation of the lighter with the lock mechanism unlocked and, wherein, an actuating lever remains inactive under any operation of the actuating lever when the locking member is located at the locking position, where the end of the actuating lever is in contact with the other end of the locking member.

A further object of this invention is to provide a gas lighter which is enhanced in safety to a greater extent by means of an automatic return function, wherein the automatic returning of the locking member is assured after the ignition of the lighter.

To these ends, according to one aspect of this invention, there is provided a gas lighter with a safety device comprising:

- a lighter body having a fuel supply means which contains fuel and upwardly supplies fuel at a regulated flow rate;
- an ignition means for igniting supplied fuel;
- an actuating lever at one end thereof engageably supporting the fuel supply means, and the other end, that is, a finger board part of which is provided with a skirt extending downwardly along the periphery thereof, a recess surrounded by the skirt, and a leg projecting downwardly near to one end of the skirt wherein the actuating lever causes the fuel supply means to give off fuel upon depression of the finger board part;
- a locking means being provided in a slidable fashion along a path which is straight formed on top of the lighter body between a locking position at the end of the path and a release position located further inside from the locking position, and having an engaging partial recess formed at the lower end of the locking means and an upwardly extending blocking end at the other upper end;

a spring means between the locking member and the lighter body so that the locking member is urged to the locking position; and a holding means including a cantilever arm extending from the wall facing the path, wherein the cantilever arm is provided with an angled engaging part for engaging the engaging recess of the locking means positioned at the release position and a protuberance part capable of abutting against the counterpart leg of the depressed actuating lever;

whereby a contact between the skirt of the actuating lever and the blocking end of the locking member prevents the depression of the actuating lever when the locking member is situated at the locking position, whilst when the locking member is pressed to the release position, the locking member remains stationary by the engagement of the recess of the locking member with the angled engaging part of the holding means, and the engagement of the blocking end of the locking member with the recess of the actuating lever enables the actuating lever to be depressed, which, in turn, causes the leg part of the actuating lever to abut against the counterpart protuberance part of the holding member, thereby releasing the engaged locking means.

In one preferred embodiment, the gas lighter may be provided with an operating member which is vertically movable relative to the locking member, wherein the operating member abuts against a stopper protuberance standing on the lighter body when the operating member is located at its lowermost end position, so that a further insertion of the operating member is obstructed, and wherein the operating member allows the locking member to be pressed to the release position when the operating member is positioned at its uppermost position, and the operating member returns from the uppermost position to the lowermost position upon depression of the actuating lever.

According to this invention, when the actuating lever is depressed, while the locking member is positioned at the end of the path on the lighter body, that is, the locking position, the skirt of the actuating lever comes in contact with the blocking end of the locking member, thereby preventing the depression of the actuating lever. In this locked state, the fuel supply means does not give off fuel.

Meanwhile, when the locking member is inserted to the release position along the path, the engaging recess of the locking member engages the engaging angled part of the holding member, so that the locking member remains at the locking position resisting the spring member. When the locking member locates at the release position, the blocking end of the locking member is situated below the recess of the actuating lever. With this arrangement, a contact between the blocking end of the locking member and the skirt part of the actuating lever is canceled. While the locking member is located at the release position, when the actuating lever is depressed, the blocking end enters the recess, and the depression of the actuating lever causes the fuel supply means to give off fuel, whereby the ignition means effects ignition of the fuel.

Associated with the depression of the actuating lever, the leg of the actuating lever depresses the protuberance of the holding member, thereby releasing the engaged locking member. Upon release of the actuating lever, the actuating lever returns upwardly, and the locking member also returns to the locking position which is at the end of the path under the compressing force of the spring member. In turn, the blocking end comes in contact with the skirt part, whereupon the lighter automatically enters the locked state wherein the actuating lever cannot be depressed, thereby preventing inadvertent ignition of the lighter.

Meanwhile, in the lighter provided with the operating member which is vertically movable along the locking member, when the operating member locates at the lowermost position thereof, the abutment of the operating member against the stopper protuberance disables the locking member from being inserted to the release position, thereby maintaining the locked state. When the operating member is moved to the uppermost position, the operating member allows the locking member to move to the release position. At this released state, the operating member descends and returns to the locking position in accordance with the depression of the actuating lever. The release of the lock is achieved stepwise only through operations, that is, the elevation and insertion of the operating member. This makes the lighter difficult to release the lock mechanism for those who are unfamiliar with the proper use of the lighter, thereby preventing inadvertent ignition of the lighter.

DETAILED DESCRIPTION OF THE PREFERRED EMBODIMENTS

Figure 1:
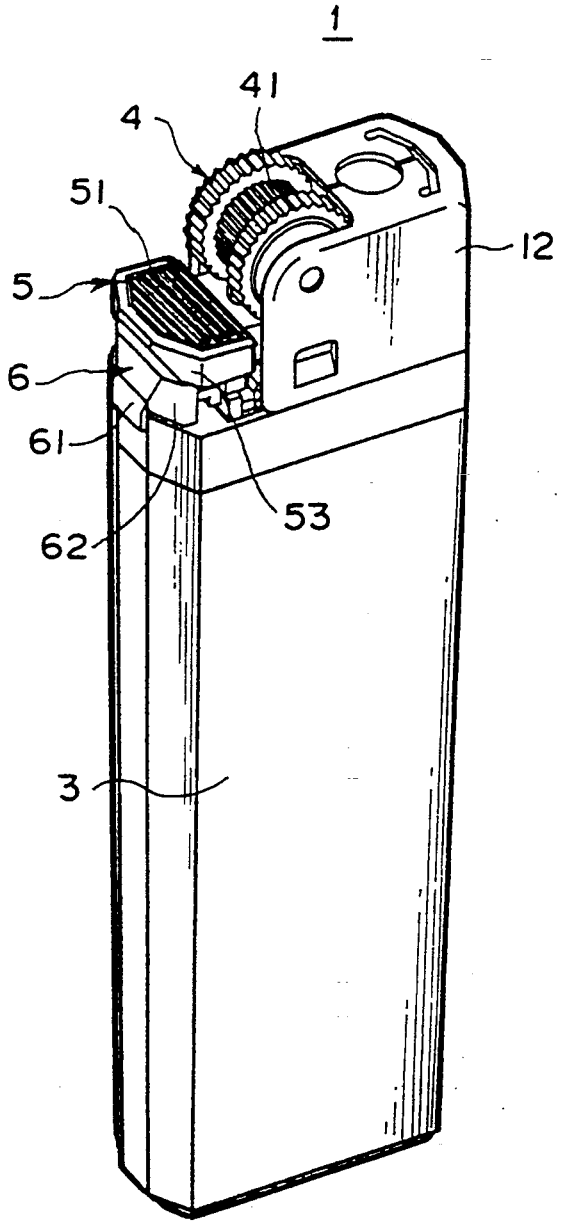
FIG. 1 is an entire perspective view showing a gas lighter with a safety device according to a first embodiment of this invention.

Upon reference to the accompanying drawings, preferred embodiments of this invention will now be described in detail.

FIRST EMBODIMENT

A gas lighter 1 with a safety device shown in FIGS. 1 to 9 is provided with a lighter body 3, for containing fuel, which includes a fuel supply means 2 having a nozzle 8 for giving off fuel gas upwards; an ignition means 4 for igniting the fuel; an actuating lever 5 for actuating the fuel supply means 2; a locking member 6 for regulating the depressing action of the actuating lever 5; and a holding member 7 for retaining the locking member 6 when the locking member 6 moves to the release position.

The lighter body 3 is in the form of parallelepiped and made up of synthetic resin. The upper open end of the lighter body is hermetically sealed with an upper closure by welding, and fuel such as butane is contained in the lighter body. A known fuel supply means 2 for regulating the emission rate of fuel is provided on the upper end of the lighter body 3, and a nozzle 8 disposed on the supply means 2 projects from the top of the lighter body 3.

The ignition means 4 is composed of a file 41 and a flint 43, the file 41 being supported by an upwardly oriented shaft 11 substantially located at the center of the lighter body 3, and the flint 43 being forcibly brought in contact with the file 41 under the compressing force of a spring 42. The flint 43 is housed in a cylindrical part 36 of the lighter body 3. The rotation of the file 41 causes sparks to be produced by a contact with the flint 43. The nozzle 8 is surrounded by a windshield cap 12 shown in FIG. 1.

Figure 2:
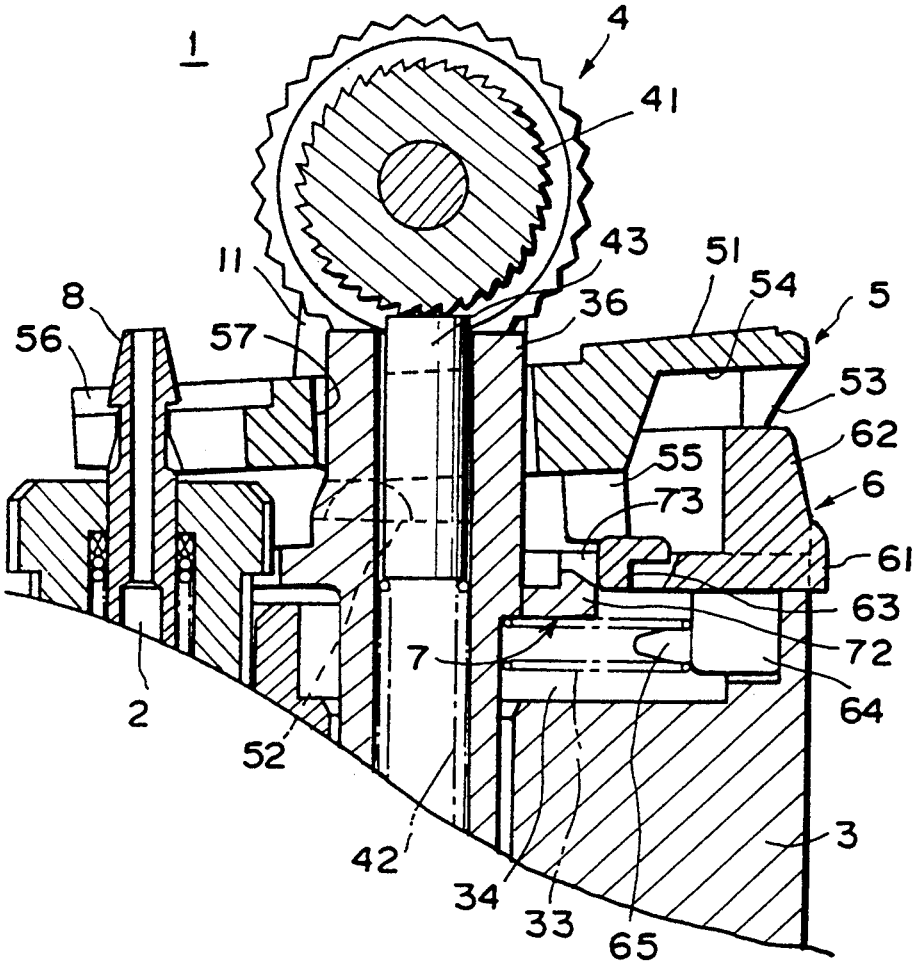
FIG. 2 is a fragmentary longitudinal cross-sectional view showing the chief elements of the gas lighter shown in FIG. 1.
Figure 3:
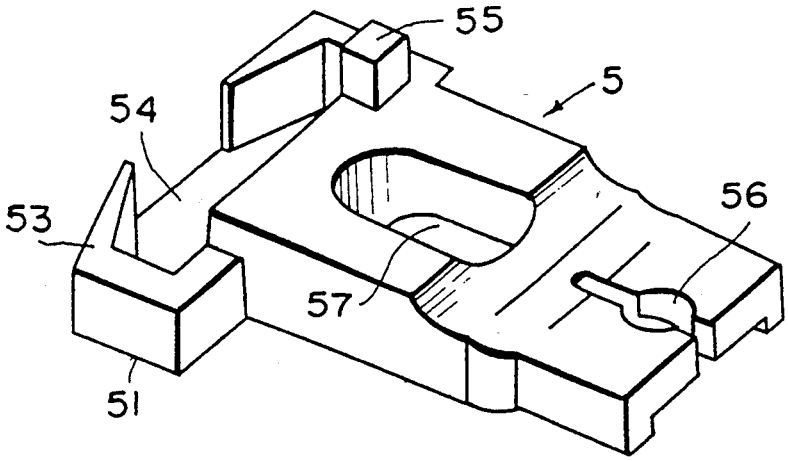
FIG. 3 is a rear perspective view showing an actuating lever.

The actuating lever 5 is disposed substantially parallel to the top of the lighter body 3 passing through the shaft 11. The actuating lever is made of a synthetic resin, and, as shown in FIG. 3, the actuating lever is at one end thereof provided with a slit-shaped engaging aperture 56 which engages with the tip end neck portion of the nozzle 8, and at the other end thereof provided with a finger board part 51. This actuating lever is movably supported in a see-saw fashion by a pivot 52 (see FIG. 2) provided in the vicinity of the shaft 11. In the middle of the actuating lever, an elongated hole 57 is formed so that the cylindrical part 36 can pass therethrough.

A recess 54 is formed on the bottom surface of the finger board 51, and a skirt part 53 projecting from the bottom surface surrounds the recess with a partial opening. A leg part 55 projecting downwardly from the bottom surface is formed in the vicinity of the recess 54 in order to release the lock member 6 from the release position.

Figure 4:
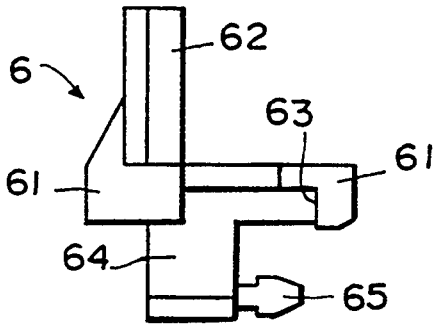
FIG. 4 is a side elevation view of a locking member.
Figure 5:
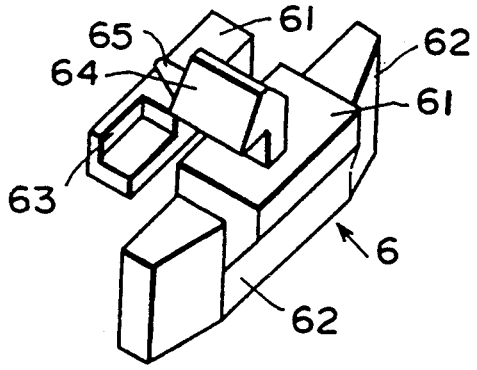
FIG. 5 is a rear perspective view showing the locking member.
Figure 6:
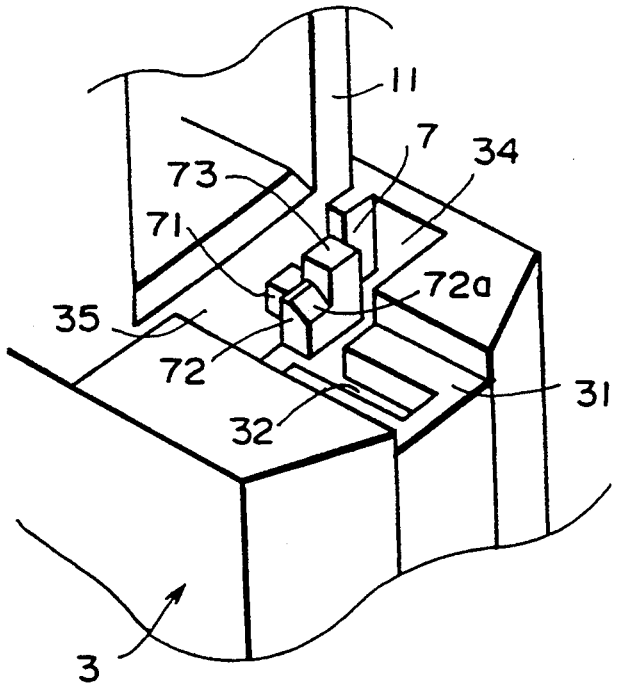
FIG. 6 is a fragmentary perspective view of a lighter body.

The locking member 6 for regulating the actuation of the actuating lever 5 is also composed of synthetic resin. The locking member 6 is, as shown in FIGS. 4 and 5, constituted of a rectangular base 61. The upper surface of an outerside base 61 is provided with a blocking end 62 which appears trapezoidal as viewed from the top thereof, and this blocking end is formed smaller than the recess 54 of the actuating lever 5, and hence is insertable into the recess. This blocking end 62 is shaped so that the blocking end can come in contact with the skirt 53 of the actuating lever 5 in accordance with the position of the lock member 6. The exterior peripheral parts of the base 61 and blocking end 62 serve as a thrusting part when the lock member 6 is inwardly thrust.

Meanwhile, the lower surface of an inner-side base 61 is provided with a recess 63 for engaging purposes. The bottom surface of the outer-side base 61 is provided with, at the center thereof, a hook 64 in the form of a fishing hook as shown in FIG. 5, and a spring receiver 65 is projectedly formed like a pin on the inner end of the hook 64.

The locking member 6 is slidably provided along a path 31 which is longitudinally formed on the top surface of the lighter body 3 (see FIG. 6), and travels between the locking position at the outer end and the release position at the inner end of the path. A guide slit 32 is further defined at the center of the lower surface of the path 31 so that the hook 64 can travel through the guide. The end of the hook part 64 engages one side of the guide slit 32 so that the lock member 6 can be held inside the path 31.

A cavity 34 is formed at the inside of the lighter body 3 adjoining to the innermost end of the path 31. A vertical wall surface 35 of the cavity 34, facing to the innermost end of the path 31 is integrally provided with the holding member 7, consisting of synthetic resin. The holding means 7 includes a cantilever arm 71, an angled engaging part 72, and a protuberance 73. The cantilever arm 71 is, at one end thereof, fixedly attached to the vertical wall surface 35 at right angles, and at the other end is provided with the angled engaging part 72 and the protuberance 73 in such a manner that the angled engaging part 72 and the protuberance 73 are suspended within the cavity 34 (see FIG. 6). The angled engaging part 72 includes a surface **72*a*, being provided on top of the engaging part and tilted towards the path 31, and the cantilever arm 71 is resiliently deformed accordingly as the base 61 of the locking member 6 slidably moves across the tilted surface 72*a*, whereupon the angled engaging part 72 engages the engaging recess 63. The protuberance 73 stood in the vicinity of the angled engaging part 72 is in the form of a rectangular, and upwardly projects. The upper surface of the protuberance is flat. This protuberance 73 is positioned opposite to the leg 55 of the actuating lever 5** so that the protuberance can abut against the leg.

The spring 33, compressedly interposed between the vertical wall surface 35 of the lighter body 3 and the hook 64 of the locking member 6, constantly thrusts the locking member 6 engaging the path 31 towards the outside of the lighter body 3, i.e., the locking position.

The principle operation of the gas lighter 1 with the foregoing structure will now be described in detail.

In a normal state wherein the locking member 6 forced to the locking position by the spring 33 is not pushed into the actuating lever, the lighter remains inactive by any actuating actions. In other words, a contact between the skirt of the finger board 51 and the blocking end 62 of the locking member obstructs the depression of the actuating lever 5 when the finger board 51 is pressed rotating the file 41 with a thumb. Accordingly, although a spark is produced by the file 41, the ignition of fuel is prevented due to the lack of fuel because the nozzle 8 engaging the end of the actuating lever 5 is not elevated.

Figure 7:
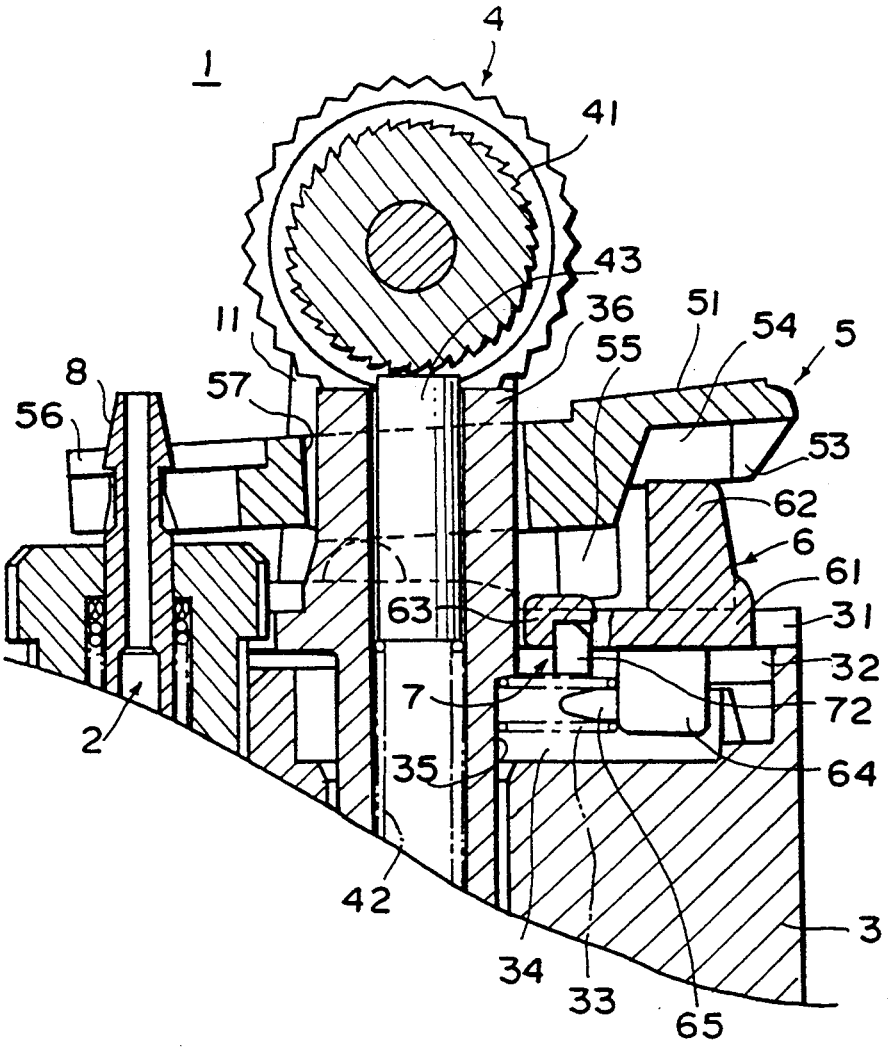
FIG. 7 is a longitudinal cross-sectional view showing the chief elements of the lighter shown in FIG. 2 when the lighter is in the released state.

When the gas lighter 1 is in use, the outer surfaces of the base 61 and blocking end 62 of the locking member 6 are pressed inside from the locking position as shown in FIG. 7. Upon insertion of the locking member, the hook 64 is slidably guided through the path 31 along the guide 32 against the compressing force of the spring 33. The leading end of the base 61 of the locking member 6 slides over the tilted surface 72*a* of the holding member 7, whereupon the engaging recess 63 defined in the locking member 6 engages the angled engaging part 72 of the holding member 7 resulting from the elastic deformation of both the engaging recess and the engaging part. The engagement between the recess 63 and the angled engaging part 72 causes the locking member 6 to be held in the release position against the compressing force of the spring 33. At this time, the blocking end 62 of the locking member 6 is displaced from the position below the skirt 53 on the bottom surface of the finger board 51 of the actuating lever 5, and enters the recess 54.

Figure 8:
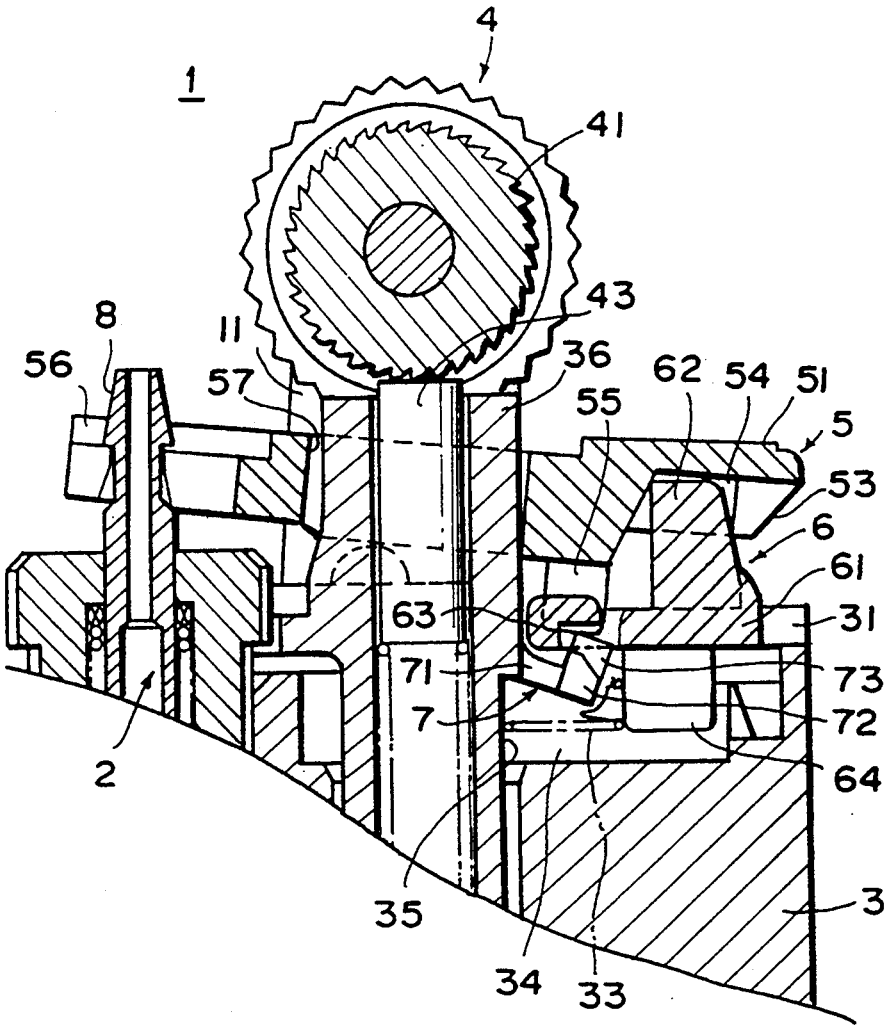
FIG. 8 is a longitudinal cross-sectional view showing the chief elements of the lighter shown in FIG. 2 when the lighter is ignited.
Figure 9:
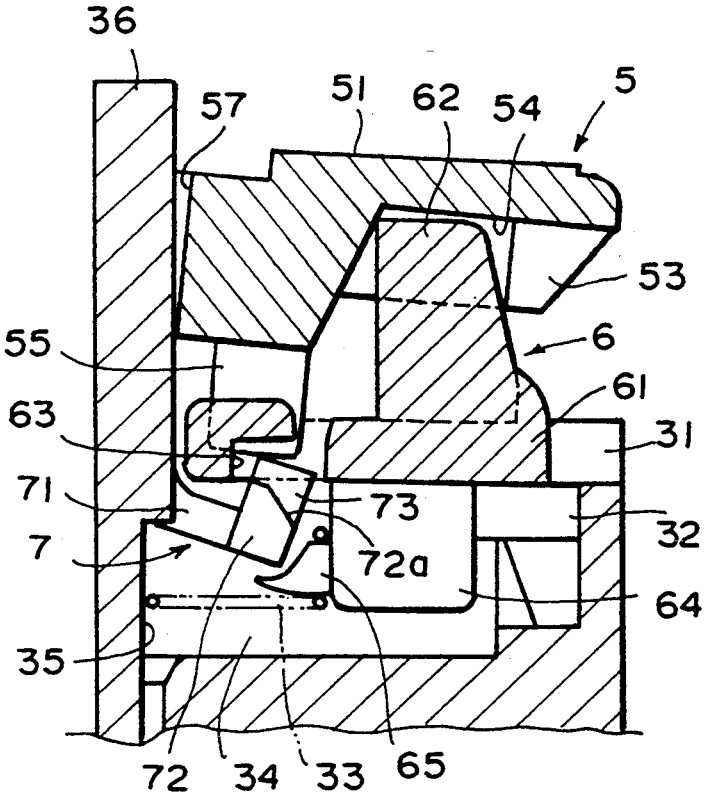
FIG. 9 is an enlarged view showing the chief elements of the lighter shown in FIG. 8.

Since the blocking end 62 of the locking member 6 held in the release position is displaced from the skirt 53 of the actuating lever 5 into the recess 54, the depression of the finger board 51 of the actuating lever 5 while the file 41 is rotated with a thumb, as shown in FIG. 8, allows the actuating lever 5 to be pressed down and, hence, causes the nozzle 8 of the fuel supply means 2 to be elevated so that the fuel is given off, whereupon the fuel can be ignited with sparks from the file 41.

Upon depression of the actuating lever 5, the leg 55 of the lever forces down the counterpart protuberance 73 formed on the cantilever arm 71. This causes the cantilever 71 along with the angled engaging part 72 to be bent and deformed downwards, whereby the angled engaging part 72 of the holding member 7 disengages from the recess 63 of the locking member 6, and the locking member is freed from the release position. The locking member 6 starts to travel to the locking position under the compressing force of the spring 33. However, while the actuating lever 5 is being pressed down, the locking member 6 temporarily remains stationary by the abutment of the top of the blocking end 62 with the skirt 53 extending along the periphery of the recess 54, so that the locking member is deterred from moving to the locking position (see FIGS. 8 and 9).

The release of the thumb from the finger board 51 of the actuating lever 5 permits the nozzle 8 to be lowered under the recovering force of a spring built in the fuel supply means 2 and, subsequently, the emission of fuel is halted, and the finger board 51 is elevated again. This leads to the top of the blocking end 62 disengaging from the recess 54, so that the blocking member 6 slidably travels outwardly along the path 31 of the lighter body 3, and automatically returns to the locking position as shown in FIG. 2.

According to this embodiment, since the locking member 6 held in the locking position is forced by the spring 33, it is ensured that the locking member is held in the locking position, and hence the lock will never be released by the weight of the lighter itself or any contacts with other articles. Moreover, since the locking member 6 is held in the release position by the holding member 7, the locking member will not return to the locking position during ignition operations, and hence it is impossible that the locking member will impede the ignition operations. Furthermore, since the locking member 6 automatically returns to the locking position associated with the ignition operations, it is prevented that the locking member is left in the release position after the use of the lighter, thereby enhancing the reliability of the lighter.

SECOND EMBODIMENT

FIGS. 10 to 18 show a gas lighter with a safety device according to a second embodiment of this invention. This gas lighter is provided with a safety device which is different from the first embodiment. Throughout the drawings, like reference numerals are provided to designate features corresponding to those in the first embodiment, and the explanation thereof will be omitted here for clarity.

As with the first embodiment, the gas lighter 10 with a safety device, according to this invention, is composed of a lighter body 3 which includes a fuel supply means 2; an ignition means 4; an actuating lever 50 for actuating the fuel supply means 2; a locking member 60 for regulating the depressing action of the actuating lever 50; a holding member 7 for retaining the locking member 6 in the release position; and an operating member 9 for pressing the locking member 60.

The principal structure of the actuating lever 50 is identical with the actuating lever of the preceding embodiment, except for the configurations of the recess 59 and skirt 58. In this embodiment, the skirt 58 completely surrounds the recess without an opening at the outer periphery thereof. The finger board 51 and leg 55 are the same as the corresponding feature of the first embodiment (see FIG. 11).

A base 66 of the locking member 60 is smaller than the base 61 of the locking member 6 of the preceding embodiment. A blocking end 67 is smaller than the blocking end 62 in thickness, and hence the blocking member projects outside from the lighter body 3 to a lesser extent, which prevents the locking member 60 from being directly pressed by a finger. The upper end of the blocking end 67 extends in the form of a flange to receive the operating member 9. The engaging recess 63, hook 64 and spring receiver 65 are the same in structure as the corresponding features of the first embodiment. This locking member 60 is forced to the locking position by means of the spring 33 similar to that of the preceding embodiment.

The operating member 9 surrounds the base 66 of the locking member 60, and slidably moves along the base vertically. The outer end of the operating member 9, facing to the outside of the lighter body, is in the form of an operating grip 91 on which a finger is put, and the ends of the operating member extend from the sides of the operating member towards each other, thereby constituting a stopper 92 This operating member 9 can travel in response to the slidable motion of the locking member 60 to the inside of the lighter body 3 along the path 31 formed on top surface of the lighter body. However, when the operating member is held in the locking position, i.e., at the lowermost position thereof where the stopper 92 abuts against a stopper protuberance 37 which will be described later, it becomes impossible to press the operating member 9 into the lighter body.

Figure 14:
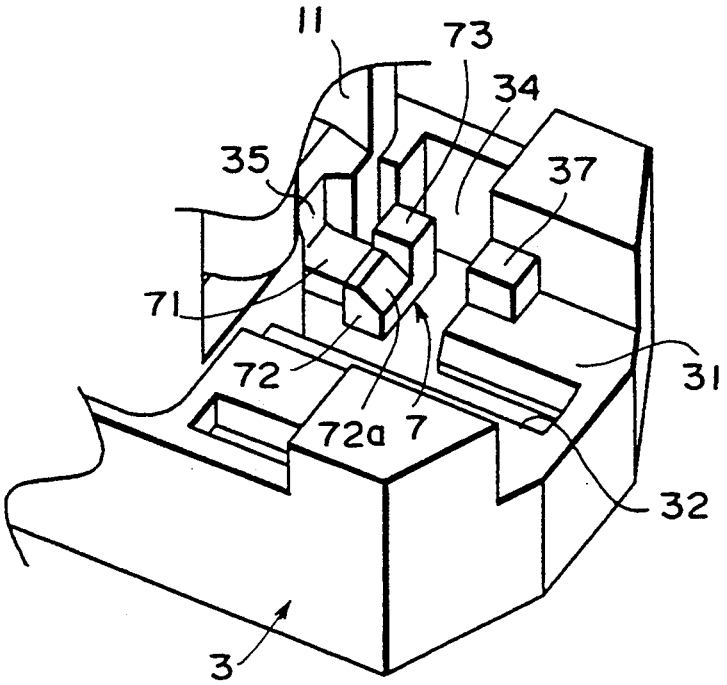
FIG. 14 is a partial perspective view of a lighter body of the lighter shown in FIG. 10.
Figure 15A:
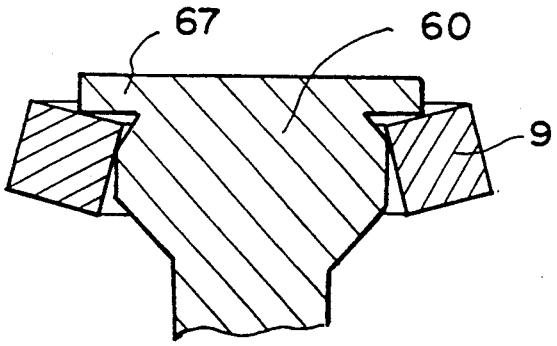
FIGS. 15A and 15B are cross sectional views showing the operation of an operating member.
Figure 15B:
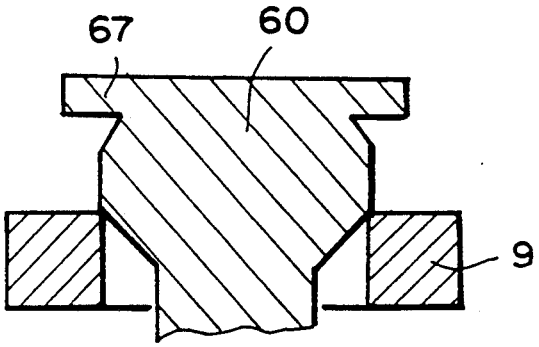

The stopper protuberance 37, which can abut against the stopper 92 of the operating member 9, stands on the upper surface of the lighter body 3 at one side of the guide slit 32 formed on the bottom surface of the path 31 as shown in FIG. 14. The side walls of the path 31 are larger than the corresponding features of the first embodiment. The guide slit 32 and cavity 34, and the cantilever arm 71, angled engaging part 72 and protuberance 73 of the holding member 7 are the same in structure as the corresponding features of the first embodiment.

The operation of the gas lighter according to this embodiment will now be described.

Figure 10:
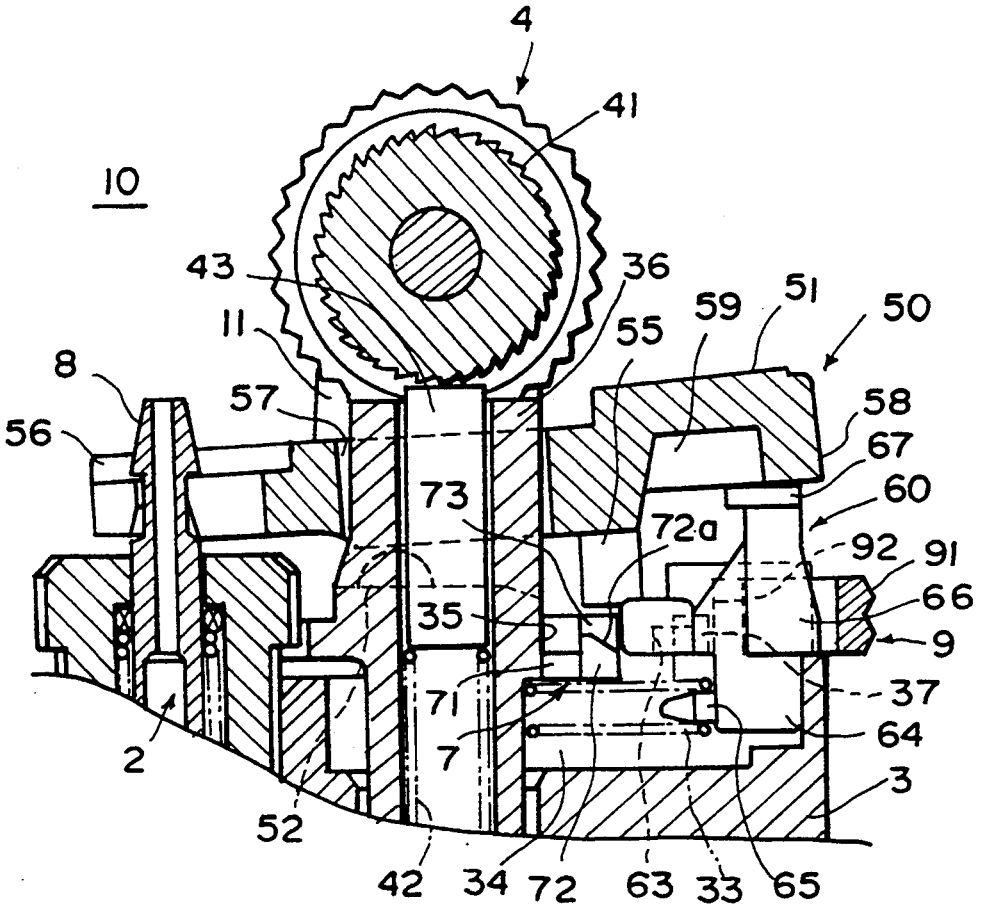
FIG. 10 is a longitudinal cross sectional view of a lighter with a safety device according to a second embodiment of this invention.
Figure 11:
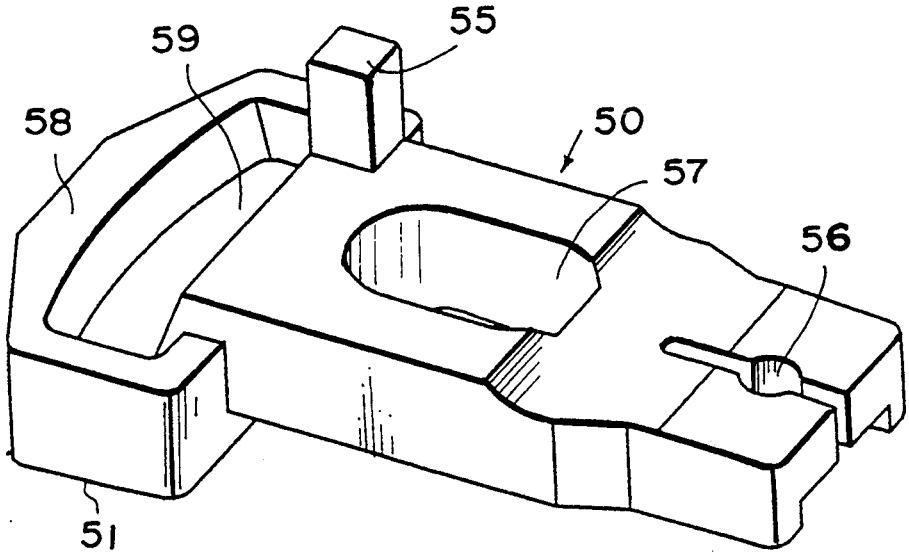
FIG. 11 is a rear perspective view of an actuating lever of the lighter shown in FIG. 10.
Figure 12:
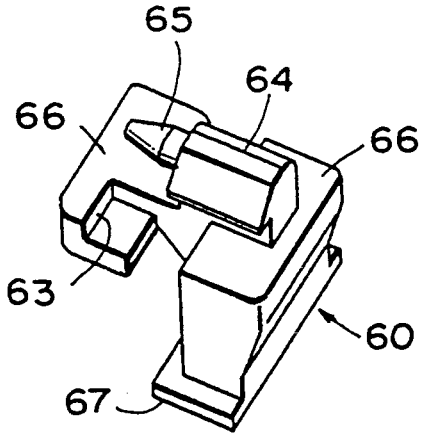
FIG. 12 is a rear perspective view of a locking member of the lighter shown in FIG. 10.
Figure 13:
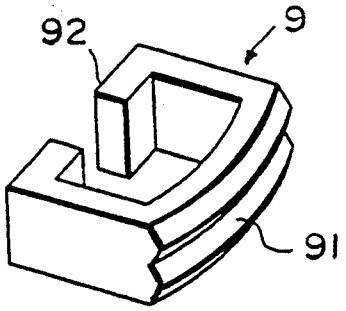
FIG. 13 is a perspective view of an operating member of the lighter shown in FIG. 10.

In a normal locking state wherein the gas lighter 10 is not in use as shown in FIG. 10, the locking member 60 is forced to the locking position by the spring 33, and the operating member 9 is situated at its lowermost position where the operating member comes in contact with the bottom surface of the path 31. A contact between the skirt 58 of the finger board 51 of the actuating lever 50 and the blocking end 67 of the locking member 60 obstructs the depression of the actuating lever 50, whereby the lighter enters the locking state wherein the ignition of the lighter is impossible. Moreover, in this locking state, even when the operating member situating at its lowermost position is inserted, the stopper 92 abuts against the stopper protuberance 37, which makes it impossible to insert the operating member. Eventually, the locking member 60 cannot move to the release position, thereby more effectively ensuring, when compared with the first embodiment, that the lighter is held in the locked state.

Figure 16:
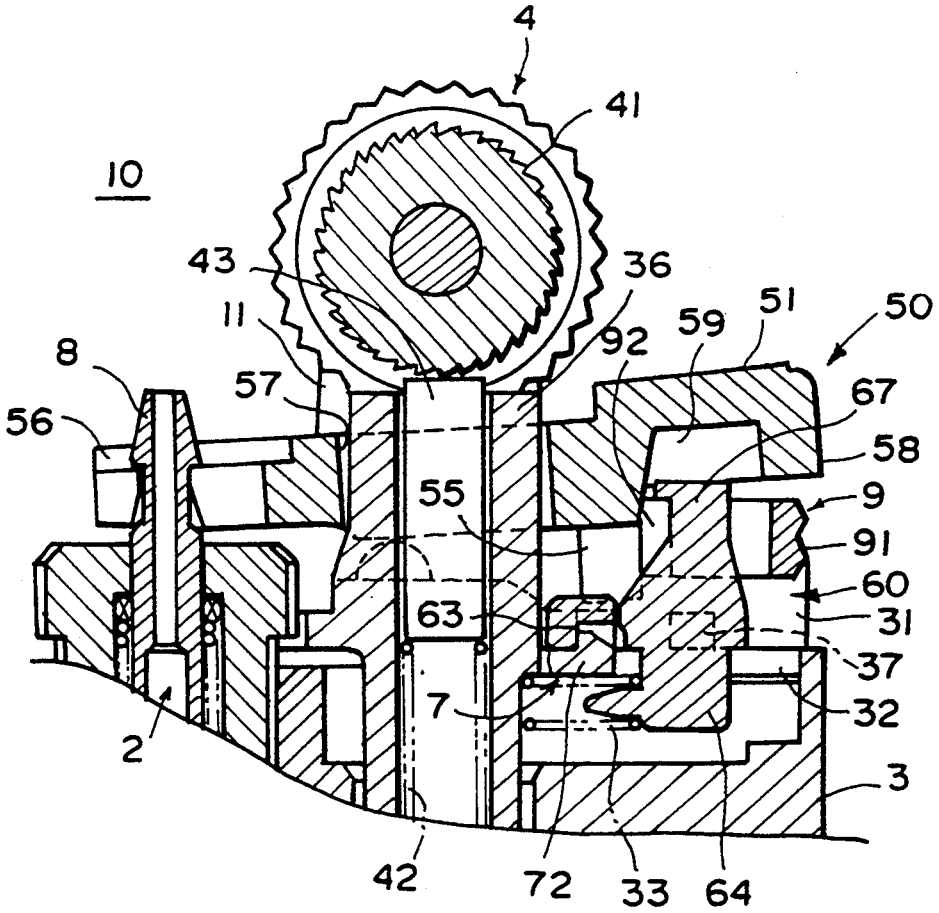
FIG. 16 is a longitudinal cross sectional view showing the chief elements of the lighter shown in FIG. 10 when the lighter is in the released state.

When the gas lighter 10 is in use, the operating member 9 is moved from its lowermost position to its uppermost position, and the stopper 92 is situated above the stopper protuberance 37. The stopper 92 becomes wider when it engages a tapered side surface of the locking member 60 below the blocking end 67 in accordance with the elevation of the stopper 92 of the operating member 9, and the operating member 9 is temporarily held under the resilience of its own. Hence, the operating member 9 will not fall to its lowermost position when the thumb is released from the operating member. Subsequently, as shown in FIG. 16, the operating member 9 is pressed into the lighter body, and the locking member 60 is inwardly moved from the locking position until the locking member locates below the recess of the actuating lever 50, whereupon the engaging recess 63 of the locking member 60 engages the angled engaging part 72, thereby holding the locking member in the release position. The blocking end 67 of the locking member 60 moves from the position below the skirt 58 of the finger board 51 of the actuating lever 50 to the position below the recess 59, thereby allowing the actuating lever to be depressed, and the lighter to be ignited.

Figure 17:
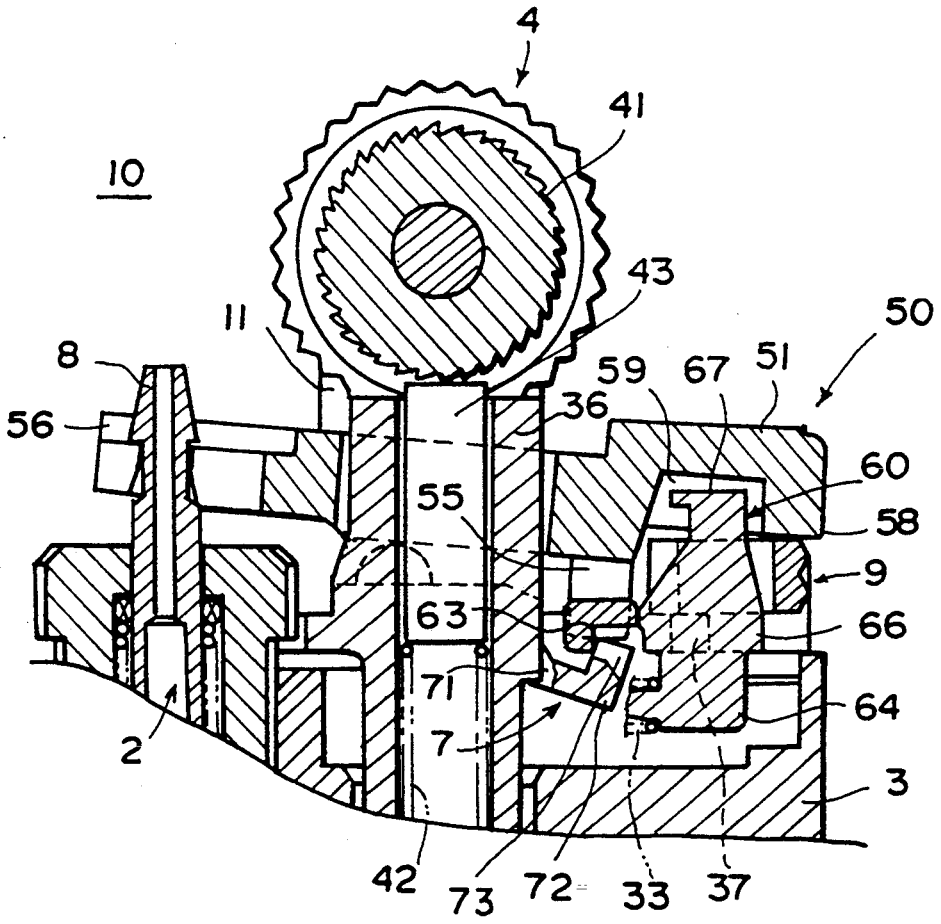
FIG. 17 is a longitudinal cross sectional view showing the chief elements of the lighter shown in FIG. 10 when the lighter is ignited.
Figure 18:
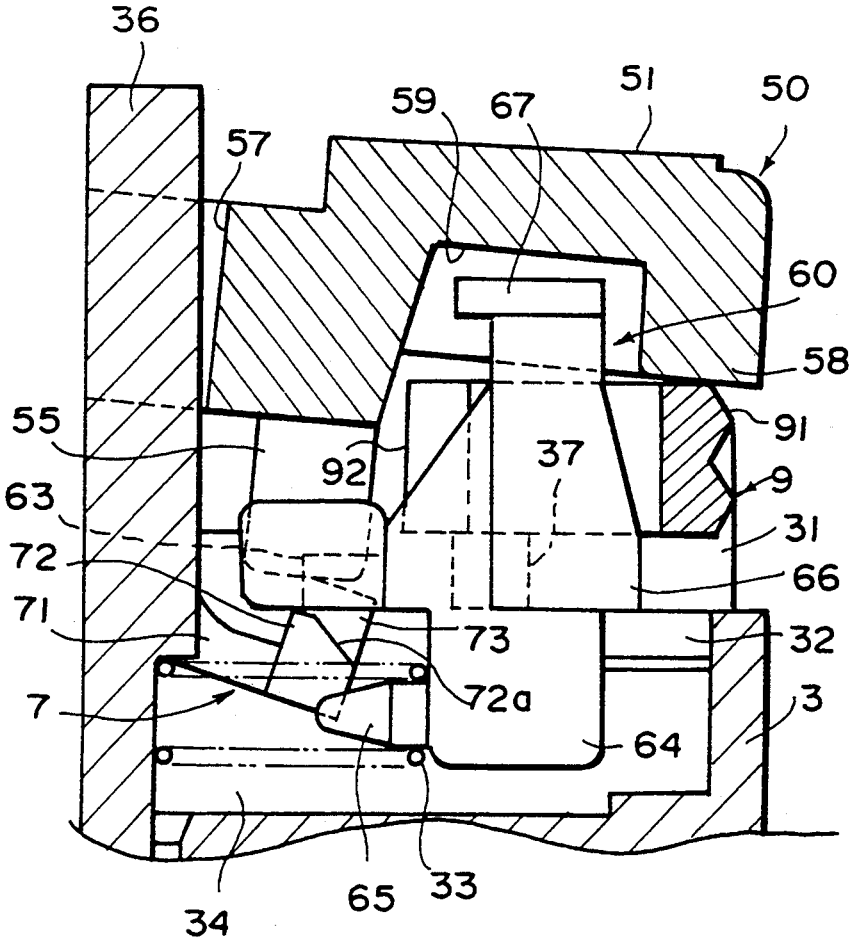
FIG. 18 is an enlarged view of the chief elements shown in FIG. 17.

When the actuating lever 50 is depressed to ignite the lighter, the operating member 9 is also descended from the lower surface of the blocking end 67 by means of the skirt 58 as shown in FIGS. 17 and 18. However, the operating member 9 thus descended abuts against the upper surface of the stopper protuberance 37 thereby preventing a further downward movement of the operating member 9 (see FIG. 15B). The leg 55 forces down the protuberance 73 formed on the cantilever arm 71 of the holding member 7, whereby the angled engaging part 72 of the holding member 7 disengages from the engaging recess 63 of the locking member 60. The locking member 60 is pressed to the locking position under the compressing force of the spring 33, but the top of the blocking end 67 is held inside the recess 59 during the ignition of the lighter; namely, while the actuating lever 50 is being depressed.

When the finger is released from the finger board 51 of the actuating lever 50 to extinguish a fire, the finger board 51 of the actuating lever 50 is elevated, and the locking member 60 automatically returns to the locking position. At this time, the operating member 9 also moves associated with the returning of the locking member, and descends at the position beyond the stopper protuberance 37 under impacts produced when the locking member comes to rest at the locking position and the weight of the operating member itself, whereby the operating member enters the locking state at its lowermost position.

According to this embodiment, since the release of the lock is achieved stepwise through two operations, i.e., the elevation and insertion of the operating member 9. This makes the lighter difficult to release the lock mechanism for those who are unfamiliar with the proper use of the lighter, thereby preventing inadvertent ignition of the lighter.

As described above, according to the gas lighter with the safety device according to this invention, the bottom surface of the finger board of the actuating lever is provided with the downwardly oriented recess and skirt, and the blocking end is formed on the leading end of the locking member which is slidably provided along the path defined on the lighter body. In addition, the engaging recess is formed on the locking member. With this arrangement, it is impossible to depress the actuating lever by the depression of any portions of the actuating lever when the locking member is located in the locking position, because the blocking end abuts against the skirt, thereby ensuring that the lighter is held in the locking state. Hence, it is possible to improve the reliability of the safety device. Also, the locking member automatically returns to the locking position associated with the operation of the actuating lever after the ignition of the lighter, thereby enhancing the safety of the lighter.

It will be understood that the above description of the present invention is susceptible to various modifications, changes and adaptations and the same are intended to be comprehended within the meaning and range of equivalents of the appended claims.

What is claimed is:

1. A gas lighter with a safety device comprising:

a lighter body having a fuel supply means which supplies fuel;

an ignition means supported by the lighter body for igniting supplied fuel;

an actuating lever having a pivot axis and first and second ends and engageably supporting the fuel supply means at the first end and a finger board part at the second end and provided with a skirt extending toward the lighter body along the periphery of the second end, the second end of the actuating lever having a recess surrounded by the skirt, and having a leg projecting toward the lighter body near one end of the skirt wherein the actuating lever causes the fuel supply means to give off fuel upon motion of the finger board part toward the lighter body;

a locking means slidably supported for motion in a path extending perpendicular to the pivot axis at an end of the lighter body between a locking position at one end of the path and a release position between the locking position and the pivot axis, the locking means having an engaging partial recess formed adjacent to the lighter body and having a blocking end at a side opposite from the lighter body;

a spring means operably disposed between the locking means and the lighter body to urge the locking means toward the locking position;

a holding means including a cantilever arm extending from a wall of the lighter body toward the path of motion of the locking means, the cantilever arm being provided with an angled engaging part for engaging the engaging recess of the locking means when the locking means is positioned at the release position and having a protuberance part capable of abutting against the projecting leg of the actuating lever when the actuating lever is positioned to cause release of fuel; and an operating member which is transversely movable relative to the path of motion of the locking means toward and away from the finger board, whereby a contact between the skirt of the actuating lever and the blocking end of the locking means prevents the actuating lever from moving to a position causing release of fuel when the locking means is situated at the locking position, and when the locking means is in the release position, the locking means is maintained stationary by the engagement of the recess of the locking means with the angled engaging part of the holding means, and the engagement of the blocking end of the locking means with the recess of the actuating lever enables the actuating lever to be moved to a position causing release of fuel which, in turn, causes the projecting leg of the actuating lever to engage the counterpart protuberance part of the holding member, thereby releasing the locking means, and the operating member engages a stopper protuberance of the lighter body when the operating member is moved to a position away from the finger board so that a further motion of the operating member is obstructed, and the operating member allows the locking means to be moved to the release position when the operating member is moved to a position adjacent to the finger board, and the operating member returns from the position adjacent to the finger board to the position away from the finger board upon motion of the actuating lever to a position causing release of fuel.

2. A gas lighter with a safety device as defined in claim 1 including a hook part formed on a surface of the locking means which slidably engages a slit formed in the lighter body along the path of motion of the locking means.

* * * * *